US006904659B1

(12) United States Patent
Plank

(10) Patent No.: US 6,904,659 B1
(45) Date of Patent: Jun. 14, 2005

(54) METHOD FOR PRODUCING AN EYELET

(75) Inventor: Otto Plank, Ybbsitz (AT)

(73) Assignee: Welser Profile AG, Osterreich (AT)

( * ) Notice: Subject to any disclaimer, the term of this patent is extended or adjusted under 35 U.S.C. 154(b) by 0 days.

(21) Appl. No.: 09/623,865

(22) PCT Filed: Jan. 15, 1999

(86) PCT No.: PCT/EP99/00217

§ 371 (c)(1),
(2), (4) Date: Nov. 8, 2000

(87) PCT Pub. No.: WO99/46069

PCT Pub. Date: Sep. 16, 1999

(30) Foreign Application Priority Data

Mar. 10, 1998 (DE) ..... 198 10 367

(51) Int. Cl.[7] ..... B23P 11/00

(52) U.S. Cl. ..... 29/432.1; 29/505; 29/509; 29/521

(58) Field of Search ..... 29/432.2, 509, 29/512, 798, 243.5, 243.53, 505, 521, 522.1, 432, 432.1

(56) References Cited

U.S. PATENT DOCUMENTS 2,441,181 A * 5/1948 Bartelheim ..... 29/432
3,882,264 A * 5/1975 Travis ..... 29/512
3,981,064 A * 9/1976 Hafner ..... 29/521
4,306,511 A 12/1981 Ashby et al.
5,042,137 A * 8/1991 Speller, Sr. ..... 29/524.1
5,737,819 A * 4/1998 Sawdon et al. ..... 29/243.5

FOREIGN PATENT DOCUMENTS

| | | |
|---|---|---|
| DE | 8903243 | 9/1991 |
| DE | 4202279 | 7/1993 |
| DE | 19540599 | 5/1997 |
| FR | 2358214 | 2/1978 |
| FR | 2426506 | 12/1979 |
| JP | 08039170 | 2/1996 |
| JP | 09201630 | 8/1997 |

* cited by examiner

*Primary Examiner*—Jermie E. Cozart
(74) *Attorney, Agent, or Firm*—Marshall, Gerstein & Borun LLP

(57) ABSTRACT

Method for production of an eyelet, during connection of workpieces where material of an outermost workpiece is pulled through openings in the other workpieces, using a single feed movement of rim hole or eyelet punch to both shape the eyelet from the one workpiece and generate the openings, in the other workpieces by breaking out one or more pieces of materials, providing a reduction in the number of operating steps and simplifying such steps.

18 Claims, 2 Drawing Sheets

METHOD FOR PRODUCING AN EYELET

REFERENCE TO RELATED APPLICATIONS

This disclosure claims the benefit of the filing date of International Application No. PCT/EP99/00217, having an international filing date of Jan. 15, 1999, which designated the United States of America, and this disclosure is the United States national stage of that international application. This disclosure further claims priority to German patent application No. 198 10 367.0, filed Mar. 10, 1998.

FIELD OF THE INVENTION

The invention refers to a method for producing a rim hole or eyelet through a pile of at least two plate-shaped work pieces and in which, by means of a rim hole punch basically driven through the pile vertically, material of one plate-shaped work piece facing the rim hole punch is pulled through an opening of the other plate-shaped work piece, whereby the inner contours of the opening basically correspond to the outer contours of the rim hole and is formed in one single feed motion of the rim hole punch, the rim hole as well as the opening at the other rear plate-shaped work piece in the feed direction of the rim hole punch in that the plate-shaped work piece turned away from the rim hole punch is supported by a die in a manner that when inserting the rim hole punch into the pile, a piece of material is broken off the rear plate-shaped work piece, the outer contour of this piece of material is basically corresponding to the outer contour of the rim hole.

A method of this type is known from the Japanese patent application 201630/1997. In this method, two stacked plates are put onto a die having a bore. A conical rim hole punch presses the two stacked plates into the die. During this movement of the rim hole punch, the two plate-shaped bodies lying on each other are substantially conically deformed, wherein in the area of the front face of the rim hole punch at the plate-shaped body facing the rim hole punch, high tensile stresses occur which effect a breaking out or punching out of a disk-shaped part of this plate-shaped body at the front face of the rim hole punch. In the further course of the movement of the rim hole punch, the plate-shaped body facing the die is deformed further, which causes it to tear out in the area of the edge of the die. The torn-off part is basically cup-shaped and falls off the rest of the plate, wherein at the same time the disk-shaped residual piece of the plate-shaped body facing the rim hole punch falls off. The rim hole is subsequently flanged to join both plate-shaped bodies. In this method, a punching of the plate-shaped body facing the rim hole punch and a subsequent break-out of the plate-shaped body facing the die takes place. This method therefore requires a rimhole punch formed as a punching tool. Moreover, the power ratios must be very balanced to ensure a correct course of the process. Since a punching process must be performed prior to the formation of a rim hole, the forces to be acted on the rim hole punch are very high.

BACKGROUND OF THE INVENTION

Further methods for producing a rim hole are known from the state of the art. For example, in DE 89 03 243 a piercing is disclosed that connects several machined parts lying on top of each other without a rivet. The machined parts are in that case each provided in a preceding work step with round holes. In doing so, the hole of a machined part lying on the outside is smaller than the holes of the other machined parts. For forming a rim hole, the edge area of the smaller hole of the machined part on the outside that covers the larger holes of the other machined parts is pressed through the holes of the other machined parts. This rim hole protrudes over the outside surface of the other machined part lying on the outside and is subsequently flanged.

A method of the type cited above as a method for joining plates is also known from DE 40 35 210 A1. In the latter, the plates to be connected are likewise punched individually in a previous work step. The plate constituting the rim hole is left un-punched. A rim hole is produced by pressing a clipping punch through work pieces piled against a pressure plate, whereby the material of the un-punched plate is pulled through the pre-drilled holes of the other plates and opens out on the other side of the plates.

In the supplemental application DE 42 02 279 A1 accompanying DE 40 35 210 A1 quoted above, a block punch is additionally used which flanges the spread-outs and thus creates a tight connection.

A disadvantage with known methods is that the machined parts or plates to be connected must be predrilled individually in a separate work step. When drilling is accomplished, a decision must be made whether the machined part or plate in question forms the rim hole, in which case a small drill hole or no drill hole is made, or whether the rim hole is pressed through the machined part or plate in question, in which case larger holes must be made. Methods of this kind are unprofitable due to the extra work steps and due to the different drill holes of the machined parts or plates, depending on intended usage, it is cumbersome and prone to error.

In order for the drill holes separately produced in each plate to meet up exactly to produce the rim hole, the sum tolerance of the drill hole position must be kept precisely. For this, however, expensive machinery and trained personnel are required.

SUMMARY OF THE INVENTION

It is thus the object of the present invention to simplify the various work steps and thus to make the method more profitable.

According to the present invention, the object for a method of the above-mentioned type is solved in that prior to formation of the rim hole a penetration opening is created through the pile whose cross-section surface corresponds at most to the cross-section surface of the opening of the rim hole.

This solution is simple and has the advantage that the individual work steps are easy to handle. First of all, the penetration opening is formed before the forming process is carried out. The manufacture of the penetration opening can for instance be made by a common drilling in a known manner. The forces to be acted on the rim hole punch can be lower, since the forming of the plate-shaped bodies is facilitated due to the penetration bore. On the whole the new method becomes more profitable.

The manufacturing costs of the process constituting the invention are thus lower than with current state-of-the-art processes, the process is simpler and less prone to error. The process is applicable to any cross-section shapes of the rim hole desired. Of particular practical importance are rim holes with circular cross-section and rim holes in the shape of oblong holes.

In addition, the process for producing the rim hole is made considerably simpler and cheaper because the inventor has, contrary to expectations, succeeded in additionally producing the rim hole simultaneously with the piece of material to be broken out in the course of a single feed movement of the rim hole punch through the pile supported by the matrix.

In an advantageous embodiment, at the end of the rim hole punch feed movement the rim hole can protrude over the rear plate-shaped workpiece surface facing the matrix. This makes sense especially if a maximum length of the rim hole is desirable, e.g. as in cutting a thread in the rim hole. In this way too, the rim hole can be processed in additional subsequent process stages.

In an advantageous manner the rim hole protruding over the rear plate-shaped work piece surface facing the matrix is preferably flanged for producing a rim hole riveting by means of a flanging punch applied from a side opposite the work piece, in which case after flanging the outer surfaces of the rim hole at least in certain sections rest on the outer surface of the rear work piece.

In a further embodiment of the invention, provision can be made for having the penetration opening through the pile produced with an essentially constant cross-section. This facilitates particularly rapid and inexpensive production of the penetration opening.

The number of work steps is reduced optimally by having, in a further advantageous embodiment, the penetration opening produced by the rim hole punch with the feed movement of the rim hole punch while the rim hole and the piece of material are simultaneously formed. Since with this embodiment penetration opening, rim hole and piece of material are produced in a single feed movement of the rim hole punch, production times and manufacturing costs can in this way be drastically reduced.

Here below, two embodiments of the process constituting the invention are described on the basis of drawings by way, of example.

The expert is encouraged at this point to determine which non-inventive sub-combinations of features described in the embodiments solve the objective task of achieving the goal of the invention at each stage according to the respective and most obvious state of the art.

DETAILED DESCRIPTION OF THE PREFERRED EMBODIMENT

Here below, the first embodiment will be explained on the basis of the schematic FIGS. 1 through 6 showing in each case the workpieces and tools in cross-section.

Figure 1:
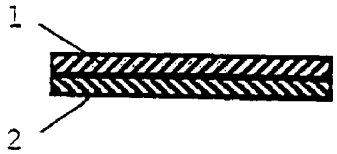
FIG. 1 shows a first step of a first embodiment of the method constituting the invention for producing a riveted joint.

FIG. 1 shows plate-shaped workpieces 1 and 2, of different thickness, piled on top of each other and which are to be joined.

Figure 2:
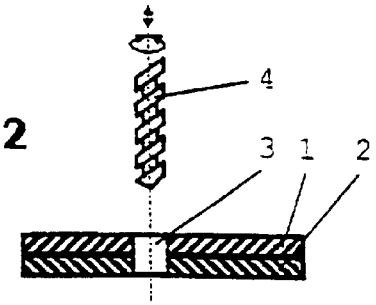
FIG. 2 shows a second step of the first embodiment of the method for producing a riveted joint.

FIG. 2 shows how a penetration drilling 3 through workpieces 1, 2 is accomplished by means of a drill 4 through vertical feed through the pile composed of workpieces 1 and 2. The diameter of the penetration drilling 3 in this embodiment example is constant throughout. Workpieces 1 and 2 are made of steel but can consist, independently from each other, of different metal materials.

Figure 3:
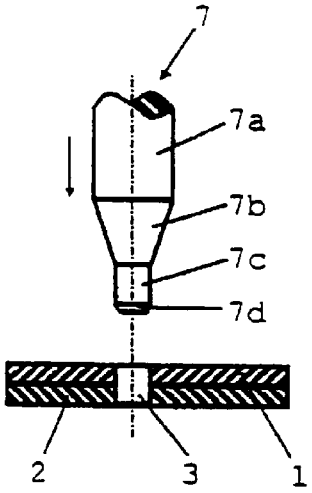
FIG. 3 shows a third step of the first embodiment of the method constituting the invention for producing a riveted joint.

In FIG. 3, the dynamically balanced rim hole punch 7 is shown consisting of several sections 7*a*, 7*b*, 7*c* and 7*d* and fed through penetration drilling 3. The phase 7*d* at the front end of the rim hole punch 7 serves for more easily driving the rim hole punch 7 into the penetration drilling 3. The connecting centring piece 7*c* centres the rim hole punch 7 in the penetration opening 3. The shaft section 7*a* has an external diameter corresponding to the internal diameter of the completed riveted joint. This diameter is larger than that of the penetration opening 3. The transition section 7*d* of the rim hole punch 7 lies between the centring piece 7*c* and the shaft section 7*a*. The rim hole punch 7 is fed vertically to workpieces 1 and 2 coaxially to the penetration drilling.

Simultaneously, the dynamically balanced matrix 8 on the opposite side of the pile from rim hole punch 7 is fed such that it supports workpiece 2 in the outer range of the circular groove 4.

Figure 4:
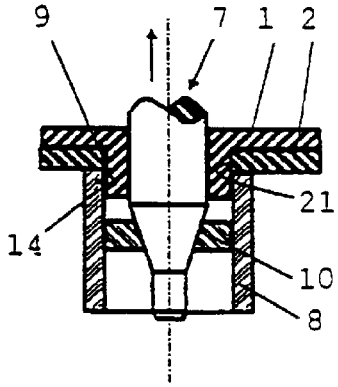
FIG. 4 shows a fourth step of the first embodiment of the method constituting the invention for producing a riveted joint.

FIG. 4 shows the end of the feed movement of the rim hole punch 7 through work pieces 1 and 2. A piece of material 10 has broken out of workpiece 2 and the rim hole 9 formed by workpiece 1 extends through the opening thus created (21) in workpiece 2. The internal diameter of the rim hole 9 corresponds to the external diameter of the shaft section 7*a*. The matrix 8 thereby supports workpiece 2.

If only one rim hole 9 is to be produced, then the process ends with this step.

Figure 5:
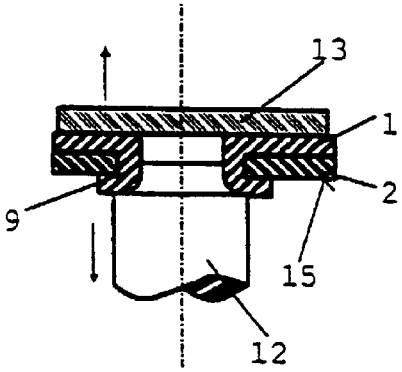
FIG. 5 shows a fifth step of the first embodiment of the method constituting the invention for producing a riveted joint.

After finishing rim hole 9 that is created during the rim hole punch's (7) feed movement shown in FIGS. 3 and 4, the rim hole 7 is flanged, as is shown in FIG. 5. For this, a dynamically balanced flange punch 12 is fed from the side of workpiece 2 along the center line 6 while simultaneously a pressure plate 13 supports the pile on the side of workpiece 1. The flange punch 12 has a shape corresponding to the finished riveted joint. In doing so, the flanged rim hole 9 rests with its outside surface 14 on outer surface 15 of workpiece 2.

Figure 6:
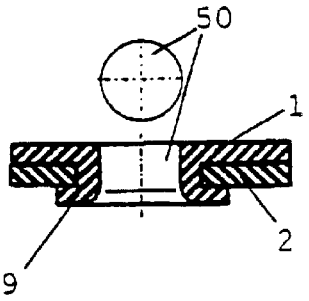
FIG. 6 shows the finished riveted joint as produced by the first embodiment of the method constituting the invention for producing a riveted joint.

This is shown a second time in FIG. 6 where the finished dynamically balanced riveted joint with the circular shaped opening 50 of the rim hole is shown. Workpieces 1 and 2 are tightly connected to each other by the flanged rim hole 9.

Here below, a second embodiment of the method constituting the invention for producing a rim hole riveting in the shape of an oblong hole is described on the basis of FIGS. 8 through 12. In doing so, only the differences in relation to the first embodiment will be dealt with in detail. Corresponding parts and devices of the second embodiment bear the same reference symbols as those of the first embodiment. FIGS. 8 through 12 show the process stages schematically in cross-section.

Figure 7:
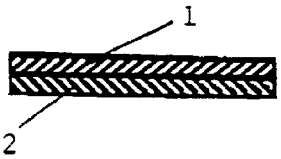
FIG. 7 shows a first step of the second embodiment of the method constituting the invention for producing a riveted joint.

FIG. 7 corresponds to FIG. 1, workpieces 1 and 2 are, nonetheless, made of aluminium in the second embodiment.

Figure 8:
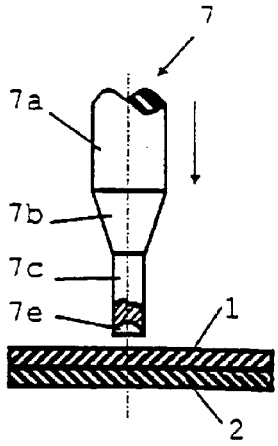
FIG. 8 shows a second step of the second embodiment of the method constituting the invention for producing a riveted joint.

In FIG. 8, a rim hole punch 7 is shown that has been modified contrary to the first embodiment and that is led through workpieces not drilled in this embodiment. Instead of phase 7*d*, the rim hole punch has a punched section 7*e*. The punched section 7*e* produces, during the rim hole punch's (7) feed movement, the penetration opening 3' in an oblong hole shape. The penetration opening 3' serves to prevent the accumulation of too much material in the rim hole 9. If too much material is actually in rim hole 9, then the material must flow particularly strongly. This generally results in a breakthrough of the rim hole and in riveted joints with reduced resistance to strains. During feed with rim hole punch 7, workpiece 2 is supported by matrix 8. However, it is also feasible that during production of penetration opening 3', workpiece 2 is supported by a smaller matrix located inside matrix 8, so that the edges of the penetration opening 3' break off clean. In this case, the internal diameter of this smaller matrix corresponds approximately to the diameter of penetration opening 3'. The punch cross-section 7*e* has the shape of an oblong hole as does as well the cross-section of shaft section 7*a* and transition section 7*d*.

Figure 9:
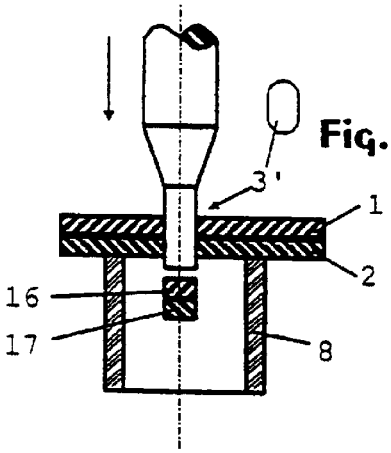
FIG. 9 shows a third step of the second embodiment of the method constituting the invention for producing a riveted joint.

In FIG. 9, a condition is shown in which the penetration opening 3' has just been created by punch section 7*e* and in which the centering piece 7*c* is located in the penetration opening 3'. For producing the penetration opening 3', two further pieces of material (16 and 17) have been created. The piece of material 17 was broken out of workpiece 2, the piece of material 16 was broken out of workpiece 1 through the punch section 7*e* of the rim hole punch 7. Matrix 8 supports workpiece 2 similarly as in the first embodiment example. In order for matrix 8 to support workpiece 2 optimally, its shape corresponds likewise to the shape of an oblong hole.

Figure 10:
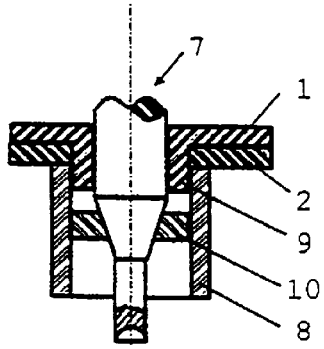
FIG. 10 shows a fourth step of the second embodiment of the method constituting the invention for producing a riveted joint.
Figure 11:
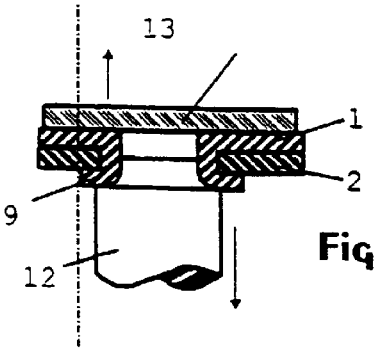
FIG. 11 shows a fifth step of the second embodiment of the method constituting the invention for producing a riveted joint.

FIG. 10 corresponds to FIG. 4 of the first embodiment, FIG. 11 likewise corresponding to FIG. 5 of the first embodiment.

Figure 12:
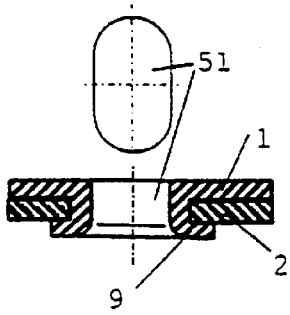
FIG. 12 shows the finished riveted joint as produced according to the second embodiment.

FIG. 12 shows that in the second embodiment in the cross-section the same type of riveted joint is created as in the first embodiment but the riveted joint nevertheless here has the shape of an oblong hole 51.

What is claimed is:

1. A method for producing a rim hole through first and second planar workpieces wherein the first and second planar workpieces are metal, comprising:

forming a penetration opening through the first and second planar workpieces by translating a first punch in a first direction to a first position;

translating the first punch, in the first direction, from the first position to a second position relative to a fixed matrix;

forming, against a working edge of the fixed matrix, a break away portion in the second planar workpiece;

forming a rim hole having a rim using the first planar workpiece such that the rim is formed adjacent to an inner surface of the matrix; and forming the rim into a single layer flange engageable with a bottom surface of the second planar workpiece, wherein the flange is formed using a flange punch and the flange punch engages the flange from a second direction that is linearly opposite to the first direction.

2. The method of claim 1, wherein the first punch has a first working surface to form the penetration opening and a second working surface to form the rim adjacent to the inner surface of the matrix.

3. The method of claim 1, wherein the flange punch is an oblong flange punch.

4. The method of claim 1, wherein the penetration opening is an oblong penetration opening.

5. The method of claim 1, wherein the first punch is an oblong punch.

6. The method of claim 1, wherein the break away portion is an oblong break away portion.

7. The method of claim 1, wherein the rim is an oblong rim.

8. The method of claim 1, wherein the rim hole is an oblong rim hole.

9. The method of claim 1, wherein the flange punch is a round flange punch.

10. The method of claim 1, wherein the first punch is a round punch.

11. The method of claim 1, wherein the rim hole is a round rim hole.

12. The method of claim 1, wherein the penetration opening is a round penetration opening.

13. The method of claim 1, wherein the break away portion is an annular break away portion.

14. The method of claim 1, wherein the rim is an annular rim.

15. The method of claim 13, wherein the round penetration hole is formed using a punch having a transition surface and a body surface.

16. The method of claim 13 or 14, wherein a transition surface of the first punch engages at least one of the plurality of planar workpieces to promote the separation of the annular break away portion and form an annular rim adjacent to the inner surface.

17. The method of claim 13 or 14, wherein the annular break away is formed against a working surface of the matrix and an annular rim is formed adjacent to the inner surface of the matrix.

18. A method for producing a rim hole through first and second planar workpieces wherein the first and second planar workpieces are metal, comprising:

forming a round penetration opening through the first and second planar workpieces by first using a circular drill and then by translating a first punch in a first direction to a first position;

translating the first punch, in the first direction, from the first position to a second position relative to a fixed matrix;

forming, against a working edge of the fixed matrix, a break away portion in the second planar workpiece;

forming a rim hole having a rim using the first planar workpiece such that the rim is formed adjacent to an inner surface of the matrix; and forming the rim into a single layer flange engageable with a bottom surface of the second planar workpiece, wherein the flange is formed using a flange punch and the flange punch engages the flange from a second direction that is linearly opposite to the first direction.

* * * * *

UNITED STATES PATENT AND TRADEMARK OFFICE

CERTIFICATE OF CORRECTION

PATENT NO. : 6,904,659 B1
DATED : June 14, 2005
INVENTOR(S) : Otto Plank

It is certified that error appears in the above-identified patent and that said Letters Patent is hereby corrected as shown below:

Column 6,
Line 34, "a punch" should be -- a first punch --.

Signed and Sealed this

Twenty-seventh Day of September, 2005

JON W. DUDAS
*Director of the United States Patent and Trademark Office*